US008505342B1

(12) United States Patent
Taiga

(10) Patent No.: US 8,505,342 B1
(45) Date of Patent: Aug. 13, 2013

(54) BICYCLE LOCK STRUCTURE WITH DUAL LATCH

(71) Applicant: Crops Co., Ltd., Tokyo (JP)

(72) Inventor: Keiji Taiga, Tokyo (JP)

(73) Assignee: Crops Co., Ltd., Tokyo (JP)

( * ) Notice: Subject to any disclaimer, the term of this patent is extended or adjusted under 35 U.S.C. 154(b) by 0 days.

(21) Appl. No.: 13/667,788

(22) Filed: Nov. 2, 2012

(51) Int. Cl.
*E05B 67/06* (2006.01)

(52) U.S. Cl.
USPC ..... 70/14; 70/38 A; 70/39; 70/49; 70/233; 70/386

(58) Field of Classification Search
USPC ..... 70/49, 233, 386, 30, 39, 38 R, 38 A, 70/38 B, 38 C, 14, 57; 439/133
See application file for complete search history.

(56) References Cited

U.S. PATENT DOCUMENTS 1,719,637 A * 7/1929 Werner ..... 70/38 A
1,728,612 A * 9/1929 Johnson ..... 70/39
2,116,965 A * 5/1938 Schoorel et al. ..... 70/38 A
2,664,734 A * 1/1954 McEneaney ..... 439/134
3,720,083 A * 3/1973 Wellekens ..... 70/38 A
5,148,690 A * 9/1992 Wang ..... 70/38 A
5,394,712 A * 3/1995 Chou ..... 70/38 A
5,592,837 A * 1/1997 McBride ..... 70/38 A
5,755,121 A * 5/1998 Crass ..... 70/52
5,950,461 A * 9/1999 Tsai ..... 70/38 A
7,117,698 B2 * 10/2006 Lai ..... 70/21
7,370,498 B1 * 5/2008 Miao ..... 70/21
7,467,531 B2 * 12/2008 Lai et al. ..... 70/38 C
7,948,359 B2 * 5/2011 Marcelle et al. ..... 340/5.64
2008/0314093 A1 * 12/2008 Nave ..... 70/21

* cited by examiner

*Primary Examiner* — Lloyd Gall
(74) *Attorney, Agent, or Firm* — Guice Patents PLLC

(57) ABSTRACT

The present invention relates to a bicycle lock structure with dual latch, which includes a latch seat and a lock body, wherein two parallel latches are set on one side of the latch seat, two inserting holes are set on one side of the lock body for inserting the latches, and at least a bead is drove to wedge into a wedged hole of the latch by a slider inside the lock body to form wedged locking, the lock picking difficulty is increased by such structure, to thereby improve the anti-theft effect.

6 Claims, 7 Drawing Sheets

BICYCLE LOCK STRUCTURE WITH DUAL LATCH

BACKGROUND OF THE INVENTION

1. Field of the Invention

The invention relates to a bicycle lock structure with dual latch and, more particularly, to a bicycle lock structure for increasing lock picking difficulty, to thereby improve the anti-theft effect.

2. Brief Description of the Related Art

A conventional bicycle lock structure 1 is shown as in FIG. 1, wherein a lock cylinder 111 is set inside a lock body 11, the lock cylinder 111 may drive a linking-up member 112 to link up a lock bolt 113, a keyhole (not shown) is set on one side of the lock body 11 for inserting a key 13 into the keyhole, and another side of the lock body 11 is jointed to one end of a steel wire 12, a latch 121 is fixed to another end of the steel wire 12, a slot 122 is set on the latch 121. When the latch 121 is inserted into an inserting hole 114 of the lock body 11, the lock bolt 113 may be wedged in the slot 122 to form a locking state. When unlocking, inserting the key 13 into and rotating the lock cylinder 111, the linking-up member 112 is drove simultaneously to drive the lock bolt 113 from the slot 122, the latch 121 may be drew out from the inserting hole 114 without being wedged to achieve the unlocking operation. However, the structure always has a great defeat that the latch 121 and the lock body 11 may become a vertical interlacing when locking. Thieves may laterally knock the lock body 11 directly by objects (such as a hammer, a stone) easily. The lock may be pried while the junction of the lock bolt 113 and the slot 122 cannot withstand the impact force, thus, the anti-theft effect is not good and widely criticized.

SUMMARY OF THE INVENTION

In view of this, the inventor finally completes the invention after numerous improvements, namely, the object of the invention is to provide a bicycle lock structure for increasing lock picking difficulty, to thereby improve the anti-theft effect.

To achieve the object, the bicycle lock structure with dual latch according to the present invention includes a latch seat and a lock body, the lock body consists of an upper cover covered on the upper side of the body, and a lock cylinder, a slider, two holders, at least a bead, a main spring and two side springs, wherein:

the latch seat, two parallel latches are set on one side of the latch seat, and two wedged holes are set respectively on the two latches;

the body, two inserting holes are set on the front side of the body for inserting the latches, a lock cylinder cavity, a main cavity and two side cavities are set inside the body, the lock cylinder cavity is used to place the lock cylinder, a first groove is set on one end of the main cavity, the first groove is provided for setting one end of the main spring into, a baffle is set at least between the main cavity and one of the side cavities, a passing groove set on the baffle is provided for the bead passing in and out, a second groove set on one end of the side cavity is provided to place the side spring for positioning, another end of the side cavities are communicated with the inserting holes;

the slider, which is placed inside the main cavity, a main groove is set on the trailing edge of the front end of the slider, the main groove is corresponded to the first groove to place another end of the main spring for positioning, a curved sidewall and a limited sidewall are set on at least one side of the front end, a side segment is extended to one side of the trailing edge of the front end, a shifting block groove is set on the side segment, the shifting block groove is provided to place a shifting block on the top end of the lock cylinder;

the holders, which are placed inside the side cavities, third grooves respectively set on one side of the holders are corresponded to the second grooves and provided to set another end of the side springs for positioning;

By the composition of the above elements, after the latches of the latch seat being inserted into the lock body, the lock body and the latch seat may become a parallel engaged state, the thief can not pry the combination of the lock body and the latch seat by knocking the lock body laterally, thus, the lock picking difficulty is increased, and the drawbacks of the conventional bicycle lock structure may be solved and the purpose of improving the anti-theft effect may be achieved.

BRIEF DESCRIPTION OF THE INVENTION

The detail structure, the applied principle, the function and the effectiveness of the present invention can be more fully understood with reference to the following description and accompanying drawings, in which.

DETAILED DESCRIPTION OF THE PREFERRED EMBODIMENTS

Figure 1:
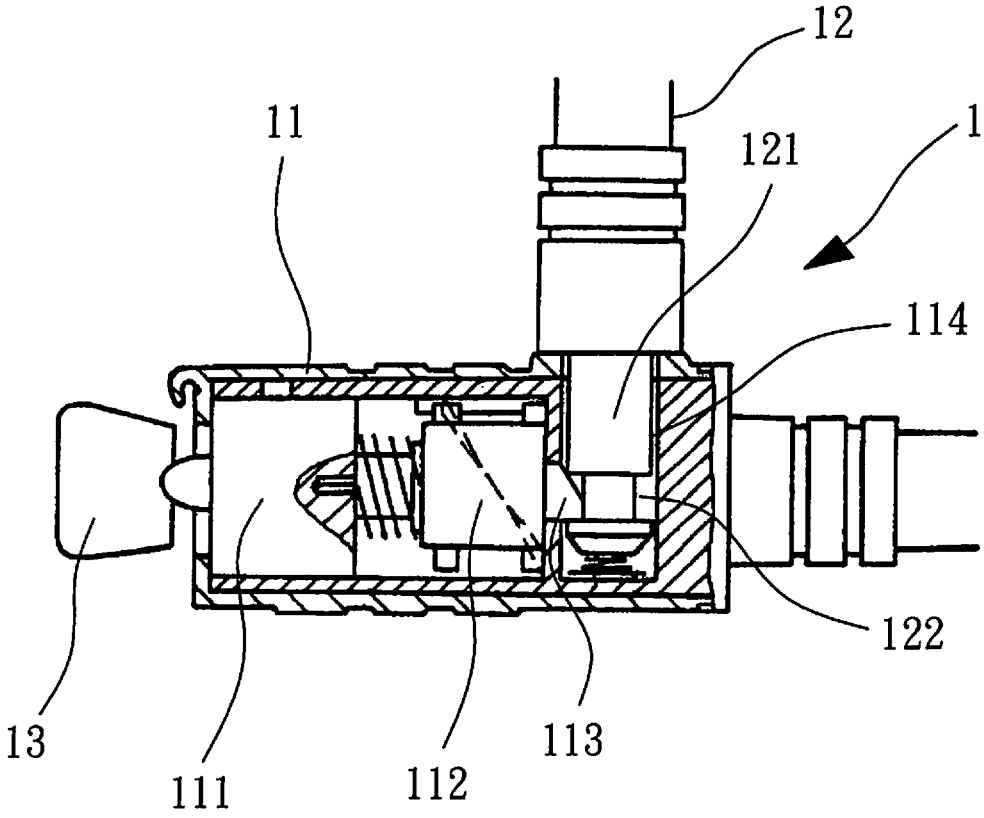
FIG. 1 PRIOR ART
FIG. 1 is a conventional bicycle lock structure.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

Figure 2:
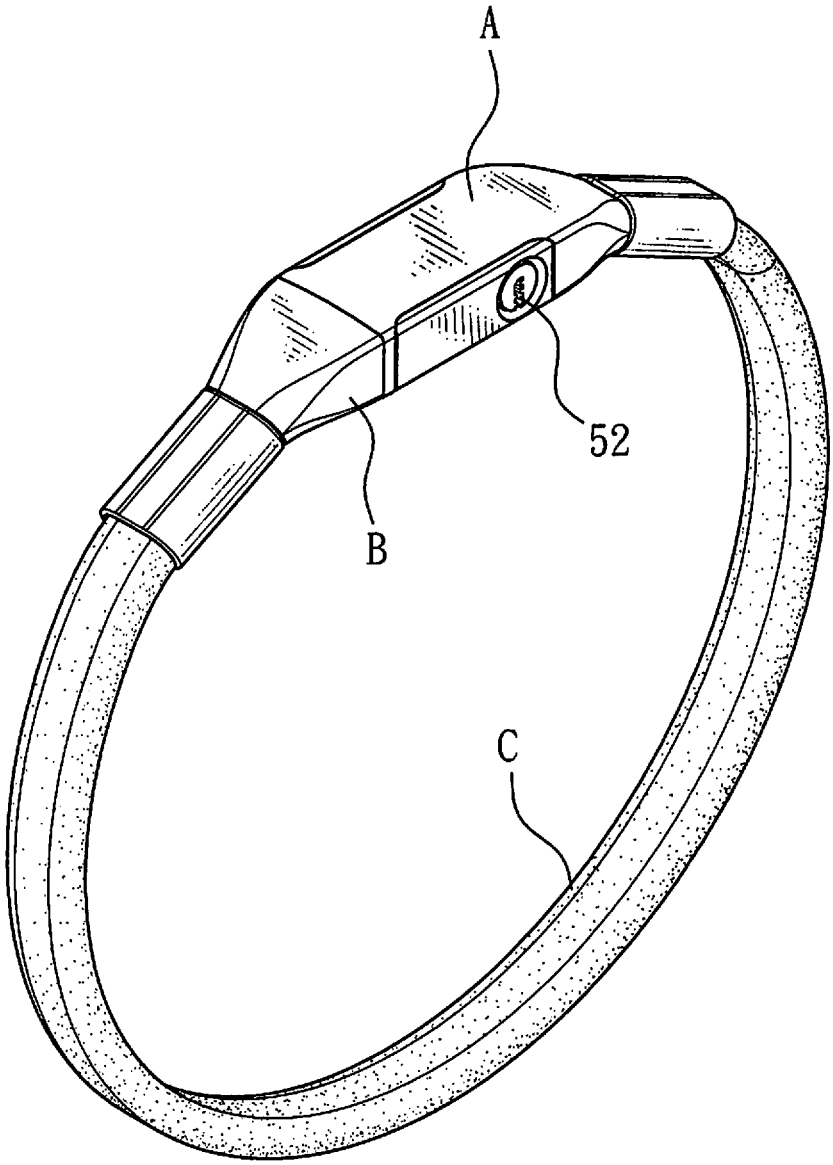
FIG. 2 is a diagram according to the present invention.
Figure 3:
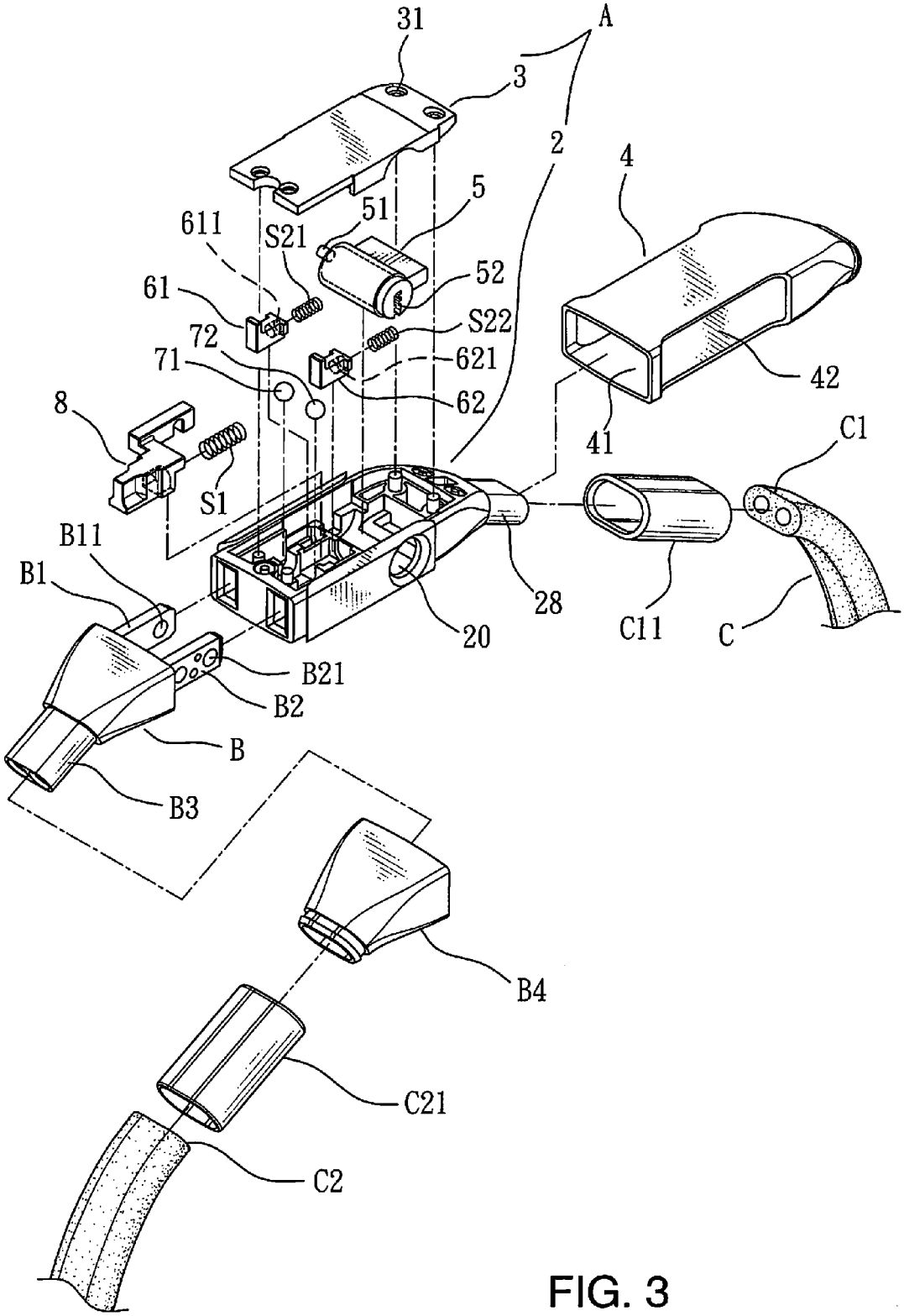
FIG. 3 is a exploded view according to the present invention.
Figure 6:
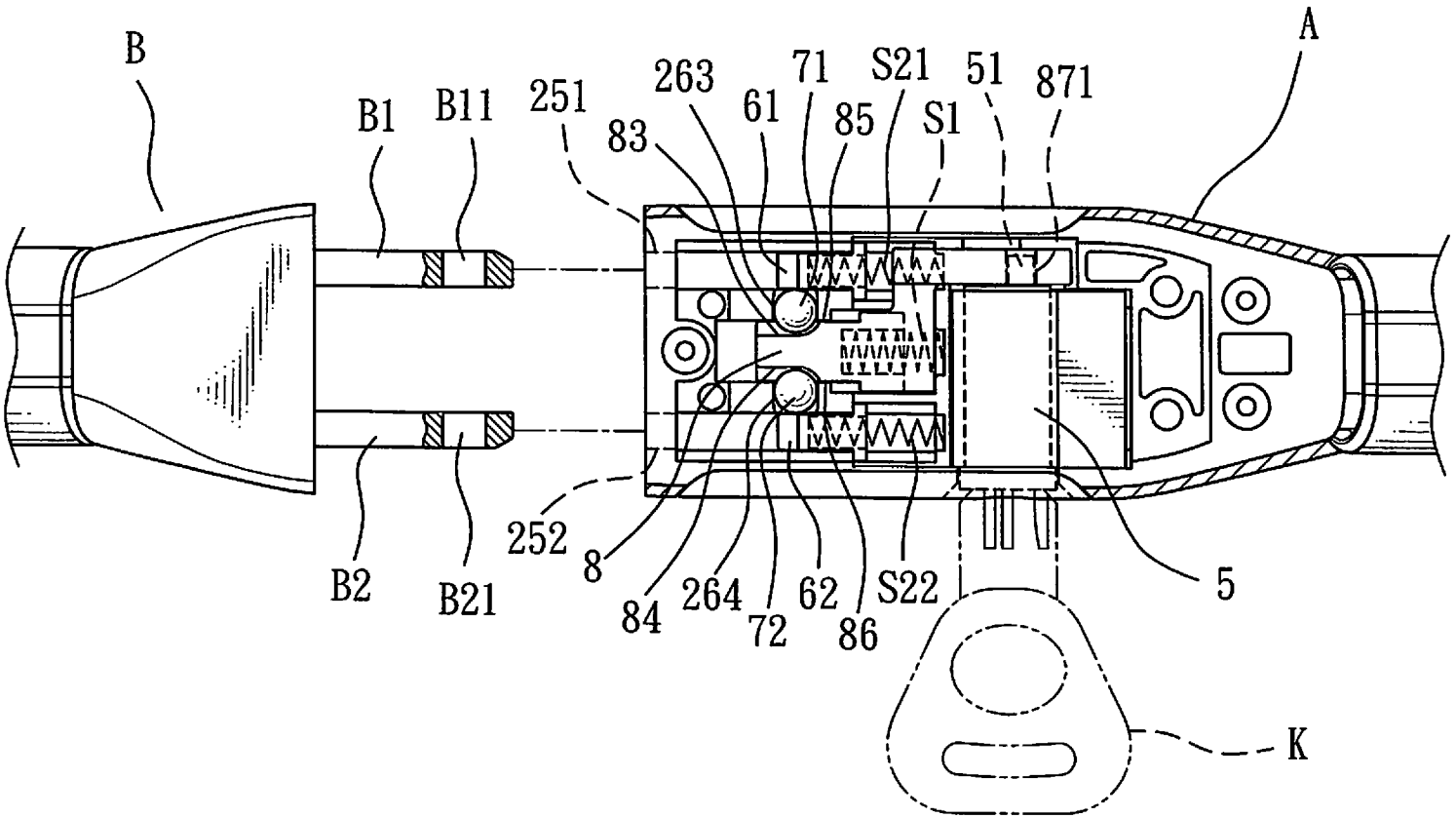
FIG. 6 is an operation schematic diagram (1) of the present invention.

Please refer to FIG. 2, FIG. 3 and FIG. 6, the bicycle lock structure with dual latch according to the present invention includes a latch seat B and a lock body A. A first jointed part 28 set on one end of the lock A is used to joint a first end C1 of a connecting member C, and a first jacket C11 is set outside the junction. A second jointed part B3 set on one end of the latch seat B is used to joint a second end C2 of the connecting member C, and a second jacket C21 is set outside the junction. A retaining shell B4 is set outside the latch seat B.

The above latch seat B, two parallel latches B1, B2 are set on one side of the latch seat B, and two wedged holes B11, B21 are set respectively on the two latches B1, B2.

Figure 4:
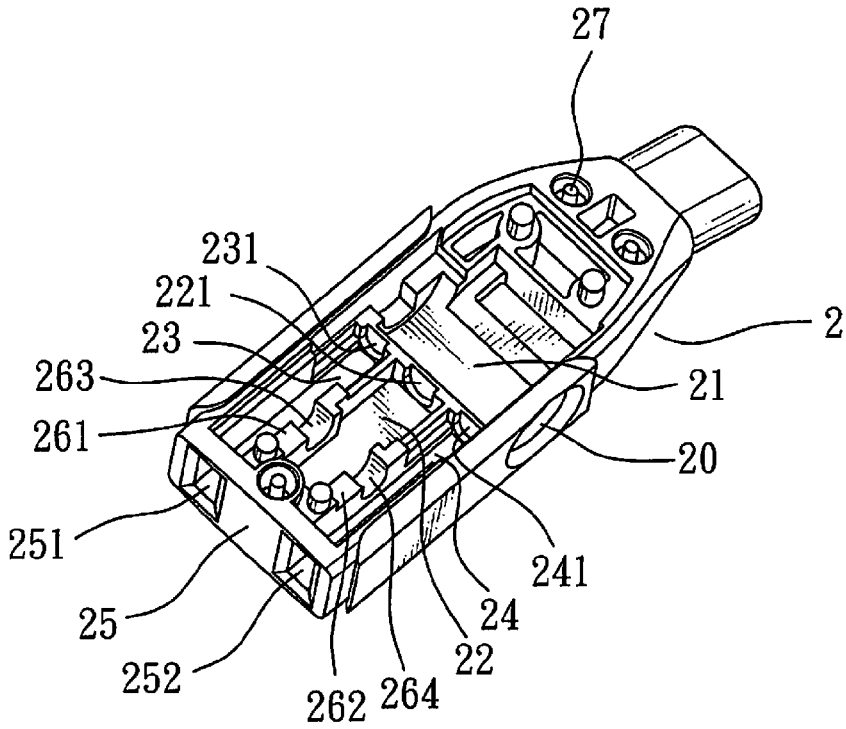
FIG. 4 is a schematic diagram of the body according to the present invention.
Figure 5:
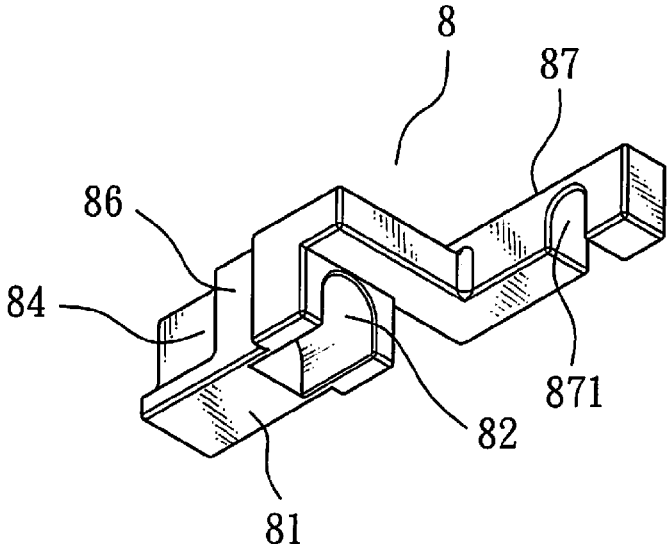
FIG. 5 is a schematic diagram of the slider according to the present invention.

The above lock A consists of an upper cover 3 covered on the upper side of the body 2, and a housing 4 is set outside of the lock body A. The housing 4 is a hollow shell body, an opening 41 is set on one side, and a lateral opening 42 is set on the lateral side. A lock cylinder 5 (the lock cylinder 5 is a conventional structure), a slider 8, two holders 61, 62, at least a bead 71, 72, a main spring S1 and two side springs S21, S22 are set inside the body 2, wherein:

the body 2, two inserting holes 251, 252 are set on the front side 25 of the body 2 for inserting the latches B1, B2, a lock cylinder cavity 21, a main cavity 22 and two side cavities 23, 24 (as shown in FIG. 4) are set inside the body 2, the lock cylinder cavity 21 is used to place the lock cylinder 5, a through hole 20 set on the location corresponding to the lock cylinder cavity 21 on one side of the body 2 is provided to reveal a keyhole 52 of the lock cylinder 5 after installing the lock cylinder 5 inside the lock cylinder cavity 21, a first groove 221 set on one end of the main cavity 22 is provided for one end of the main spring S1 setting into for positioning, at least one baffle 261, 262 is set between the main cavity 22 and at least a cavity 23, 24, the passing grooves 263, 264 are set on the baffles 261, 262 for the beads 71, 72 passing in and out, second grooves 231, 241 are respectively set on one end of the side cavities 23, 24, the second grooves 231, 241 are provided to place one end of the side springs S21, S22, another end of the side cavities 23, 24 are communicated with the inserting holes 251, 252;

the slider 8 (as shown in FIG. 5), which is placed inside the main cavity 22, a main groove 82 set on the trailing edge of the front end 81 of the slider 8 is corresponded to the first groove 221 and provided for one end of the main spring S1 setting into for positioning, curved sidewalls 83, 84 and limited sidewalls 85, 86 are set on at least one side of the front end 81, a side segment 87 is extended to one side of the trailing edge of the front end, a shifting block groove 871 is set on the side segment 87, the shifting block groove 871 is provided to place a shifting block 51 on the top end of the lock cylinder 5;

the holders 61, 62, which are placed inside the side cavities 23, 24, third grooves 611, 621 are respectively set on one side of the holders, the third grooves 611, 621 are corresponded to the second grooves 231, 241 for setting another end of the side springs S21, S22 for positioning The above lock body A, multiple assembly columns 27 are set on the body 2, and the assembly columns 27 are corresponded to multiple assembly holes 31 on the upper cover 3 for fixedly covering the upper cover 3 on the body 2.

Figure 7:
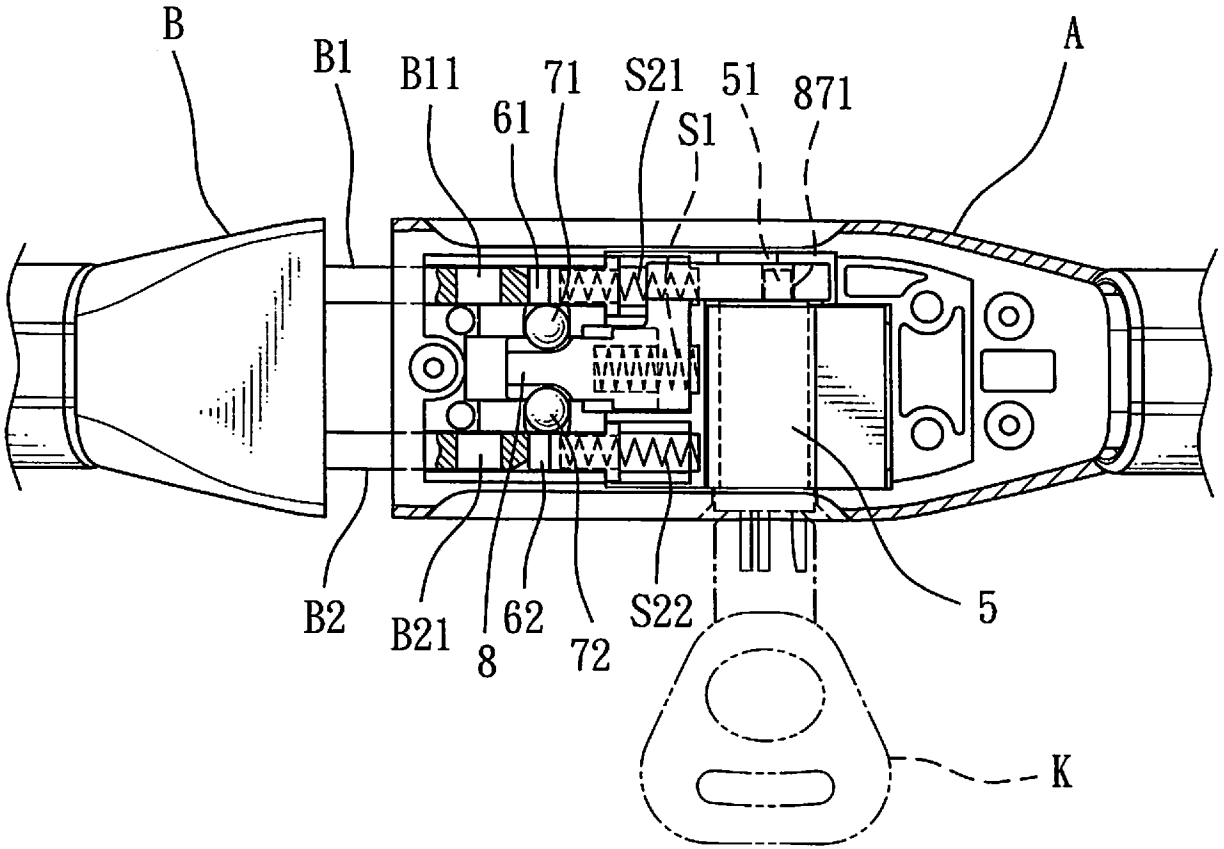
FIG. 7 is an operation schematic diagram (2) of the present invention.
Figure 8:
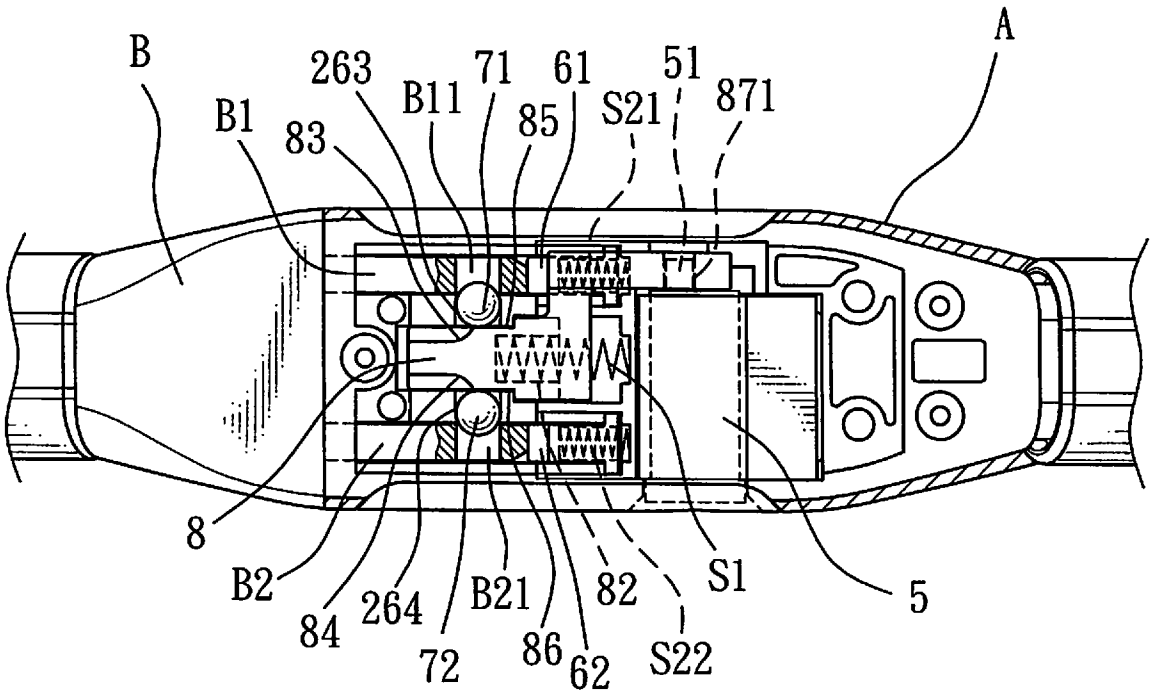
FIG. 8 is an operation schematic diagram (3) of the present invention.

The bicycle lock structure with dual latch composed by the above elements, when locking (please refer to FIG. 6, FIG. 7, FIG. 8), the latches B1, B2 of the latch seat B are inserted into the inserting holes 251, 252 of the lock body A first, the holders 61, 62 is pushed inward simultaneously, when the wedged holes B11, B21 of the latches B1, B2 is pushed to align the location of the passing grooves 263, 264, the slider 8 is pushed outward by the elasticity of the main spring S1 and the beads 71, 72 moves to the position of the limited sidewalls 85, 86 from the position of the curved sidewalls 83, 84, the beads 71, 72 is pushed into the passing grooves 263, 264 due to altitude difference and wedged into the wedged holes B11, B21, the shifting block 51 is linked up when the slider 8 pushed outward to rotate the lock cylinder 5 to the locked position to thereby form a wedged locked state, and the locking operation is complete after getting out the key K; otherwise, when unlocking, inserting the key K into the keyhole 52 and rotating the lock cylinder 5, the shifting block 51 is linked up by the slider 8 and moved inward, the beads 71, 72 moves back to the location of the curved sidewalls 83, 84 from the location of the limited sidewalls 85, 86 simultaneously, at the time, the side springs S21, S22 may restore elasticity without limiting by the wedged block of the beads, the holders 61, 62 are pushed to pop up the latches B1, B2 from the inserting holes 251, 252, to thereby separate the latch seat B and the lock body A, to thereby complete the unlocking operation.

The above connecting member C of the present invention is a steel wire body or a chain.

Above all, in the present invention, two latches are used to insert into the lock body to lock, and the lock body and the latch seat become a parallel engaged state, the thief can not pry the combination of the lock body and the latch seat by knocking the lock body laterally, so the lock picking difficulty is increased, thus, the drawbacks of the conventional bicycle lock structure may be solved and the purpose of improving the anti-theft effect may be achieved. Therefore, the present invention has patent novelty and practical progress.

I claim:

1. A bicycle lock structure with dual latch, which includes a latch seat and a lock body, the lock body consists of an upper cover covered on the upper side of a body, and a lock cylinder, a slider, two holders, at least a bead, a main spring and two side springs, wherein:

the latch seat, two parallel latches are set on one side of the latch seat, and two wedged holes are set respectively on the two latches;

the body, two inserting holes are set on a front side of the body for inserting the latches, a lock cylinder cavity, a main cavity and two side cavities are set inside the body, the lock cylinder cavity is used to place the lock cylinder, a first groove is set on one end of the main cavity, the first groove is provided for setting one end of the main spring into, a baffle is set at least between the main cavity and one of the side cavities, a passing groove set on the baffle is provided for the bead passing in and out, a second groove set on one end of the side cavity is provided to place the side spring for positioning, another end of the side cavities are communicated with the inserting holes;

the slider, which is placed inside the main cavity, a main groove is set on a trailing edge of a front end of the slider, the main groove is corresponded to the first groove to place another end of the main spring for positioning, a curved sidewall and a limited sidewall are set on at least one side of the front end, a side segment is extended to one side of the trailing edge of the front end, a shifting block groove is set on the side segment, the shifting block groove is provided to place a shifting block on a top end of the lock cylinder;

the holders, which are respectively placed inside the side cavities, third grooves respectively set on one side of the holders are corresponded to the second grooves and provided to set another end of the side springs for positioning.

2. The bicycle lock structure with dual latch as claimed in claim 1, wherein a through hole is set on the location corresponding to the lock cylinder cavity on one side of the body.

3. The bicycle lock structure with dual latch as claimed in claim 1, wherein a first jointed part is set on one end of the lock body for jointing a first end of a connecting member.

4. The bicycle lock structure with dual latch as claimed in claim 1, wherein a second jointed part is set on one end of the latch seat for jointing a second end of a connecting member.

5. The bicycle lock structure with dual latch as claimed in claim 1, wherein a retaining shell is set outside of the latch seat.

6. The bicycle lock structure with dual latch as claimed in claim 1, wherein a housing is set outside of the lock body.

* * * * *